United States Patent [19]

McAuley

[11] Patent Number: 4,989,815

[45] Date of Patent: Feb. 5, 1991

[54] RELEASABLE CONNECTOR SYSTEM

[75] Inventor: William McAuley, Lincoln, R.I.

[73] Assignee: Superior Jewelry Company, Cincinnati, Ohio

[21] Appl. No.: 527,107

[22] Filed: May 22, 1990

[51] Int. Cl.[5] ..... A47F 7/00

[52] U.S. Cl. ..... 248/225.2; 248/220.3; 248/227; 211/59.1; 211/13

[58] Field of Search ..... 248/225.2, 221.3, 227, 248/220.2, 220.3, 215, 304, 307, 340, 221.2; 211/59.1, 57.1, 13

[56] References Cited

U.S. PATENT DOCUMENTS

| | | | |
|---|---|---|---|
| D. 294,113 | 2/1988 | Smyth, III | 248/221.2 X |
| 1,709,144 | 4/1929 | Mueller . | |
| 1,743,831 | 1/1930 | Schurr . | |
| 3,017,972 | 1/1962 | Saxe | 189/36 |
| 3,279,620 | 10/1966 | Nesbitt | 211/87 |
| 3,306,564 | 2/1967 | Nickel | 248/220.3 |
| 3,888,884 | 6/1968 | Eggler et al. | 248/224 |
| 4,189,796 | 2/1980 | Gutner | 5/8 |
| 4,264,013 | 4/1981 | Vollmer | 211/13 |
| 4,300,692 | 11/1981 | Moreno | 211/87 |
| 4,340,106 | 7/1982 | Van Horn, II | 160/332 |
| 4,352,478 | 10/1982 | Loew | 248/221.3 |
| 4,429,850 | 2/1984 | Weber et al. | 248/250 |
| 4,531,331 | 7/1985 | Itagaki | 52/38 |
| 4,671,417 | 6/1987 | O'Brien | 211/59.1 |
| 4,768,660 | 9/1988 | Handler et al. | 248/222.1 X |
| 4,826,022 | 5/1989 | Duarte | 211/59.1 |
| 4,860,905 | 8/1989 | Schott et al. | 248/220.3 X |
| 4,899,971 | 2/1990 | Elkin | 248/221.3 X |

FOREIGN PATENT DOCUMENTS

| | | | |
|---|---|---|---|
| 1526216 | 5/1968 | France | 248/221.3 |
| 460281 | 9/1968 | Switzerland | 211/59.1 |
| 15278 | of 1906 | United Kingdom | 248/225.2 |

*Primary Examiner*—Karen J. Chotkowski

*Attorney, Agent, or Firm*—Wood, Herron & Evans

[57] ABSTRACT

A connector system having a fixed base and a removable portion. The removable portion is fitted with a projection having a flexible prong. The projection is inserted into a channel on the fixed base and the prong is pressed into an aperture within the channel over a raised lip. The prong in combination with an inwardly projecting tip flexes as the tip rides over the raised lip and then reassumes its original orientation beyond the lip to lock the removable portion into position. The connector system is especially useful as a display device for small pieces of merchandise, such as jewelry.

17 Claims, 1 Drawing Sheet

RELEASABLE CONNECTOR SYSTEM

FIELD OF THE INVENTION

The invention relates to connector systems having a fixed base and a removable portion, and specifically to an item display device having a display panel and removable display hook.

Background of the Invention

There is a continuing need for connector systems which combine flexibility of use with ease of adjustment. These systems are intended to include any combination of a fixed base and a removable portion which may be placed at any one of a number of positions on the fixed base. Representative connector systems are wall shelving units, room and office partitions, window displays, and merchandise display units, wherein flexibility in positioning the removable portion on the fixed base is a key requirement.

Specifically, this need is apparent in display devices for small items such as jewelry. Because of the nature of the item, jewelry stock is constantly changing. Further, jewelry is sold in a variety of sizes and types, such as pins, earrings, chains, bracelets, and the like. Further, it is desirable to maximize product exposure on the display device and to arrange the sale items in a tasteful manner on the device.

SUMMARY OF THE INVENTION

The invention relates to a display device having a display hook which removably locks onto a fixed panel having a plurality of securing sites. Though display devices, especially for small items such as jewelry, have been available, the present invention employs a unique locking mechanism which allows for both flexibility of use and ease of adjustment. The fixed surface, or panel, has at least one channel thereon, with at least one wall non-parallel to the panel. In that wall are apertures, through which a prong from the display hook member is inserted. The display hook is maintained in a secure relation to the panel by means of a projecting tip on the hook member which rides over and then locks behind a raised lip near the aperture on the panel.

Other connector systems of varying sizes and types, such as wall shelving units, office and room partitions, window displays and the like, also may employ the locking mechanism of the display device to good effect.

It is therefore an object of the invention to provide a display device which allows for both flexibility of use and ease of adjustment.

It is a further object of the invention to provide a connector system which employs an easily removable yet positively locking coupling system.

It is yet a further object of the invention to provide a coupling mechanism for use on wall shelving units, partitions, window displays, and the like.

Additional objects and advantages of the invention will become apparent from the following description and from the drawings, in which:

DETAILED DESCRIPTION OF THE DRAWINGS

DETAILED DESCRIPTION OF THE INVENTION

Figure 1:
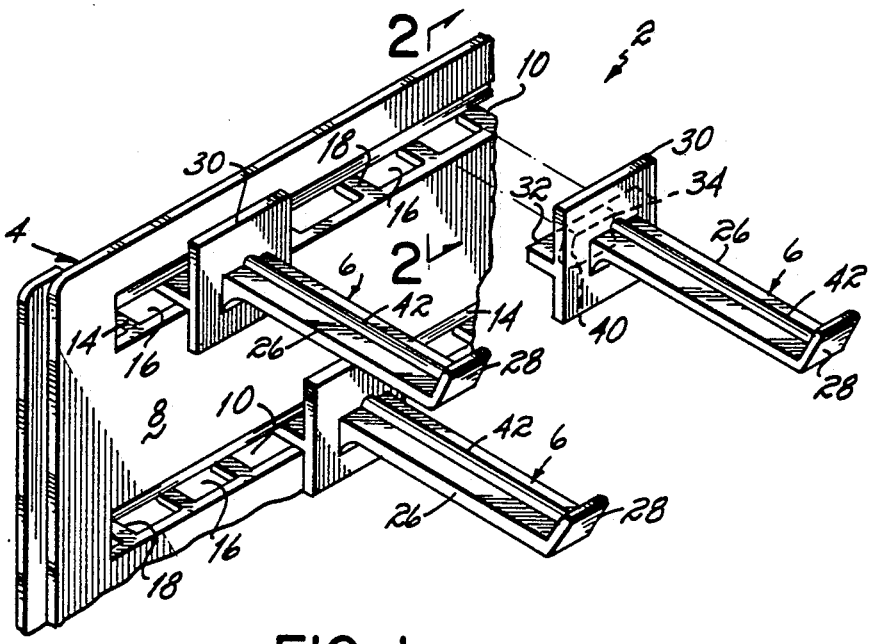
FIG. 1 is a front perspective view of a display device.

In its broader aspects, the invention relates to a connector system for securing objects to a fixed member comprising a panel having a primary flat surface with at least one channel recessed from that surface, the channel having at least one wall non-parallel to the primary flat surface, the wall having at least one aperture therein with a raised lip on the reverse side of the primary flat surface adjacent to the aperture; and a securing member having a flange with a projection extending therefrom, the projection attached to a prong having substantially the same length as the aperture, the prong having an inwardly projecting tip capable of engaging the lip adjacent to the aperture. Preferably the recessed channel runs in a substantially horizontal direction, though it can be appreciated that the channel can also run vertically or along an angle from the vertical, depending on the application. Also, the non-parallel wall having the aperture is preferably substantially perpendicular to the primary flat surface, but may be any one of a variety of angles, depending on the application. Where the wall is substantially perpendicular to the primary flat surface, the projection on the securing member extends substantially perpendicularly from the flange. To improve the flexibility of use of the invention, the wall of the channel has a plurality of discrete apertures separated by individual spacer members. The raised lip adjacent to the aperture preferably extends along substantially the entire length of the aperture, though it is envisioned that the raised lip can extend along only a portion of the length of the aperture. To render the securing member more stable after coupling to the panel, the securing member flange is constructed to contact the primary flat surface to aid in distributing weight from the securing member onto the flat surface.

The invention further envisions a device for displaying items of merchandise comprising a display panel having a primary flat surface with at least one channel recessed from that surface, the channel having at least one wall non-parallel to the primary flat surface, the wall having at least one aperture therein with a raised lip on the reverse side of the primary flat surface adjacent to the aperture; and a display hook having a flange with a projection extending therefrom, the projection attached to a prong having substantially the same length as the aperture, the prong having an inwardly projecting tip capable of engaging the lip adjacent to the aperture. As with the connector system, preferably the recessed channel runs in a substantially horizontal direction, though it can be appreciated that the channel can also run vertically or along an angle from the vertical, depending on the application. Also, the non-parallel wall having the aperture is preferably substantially perpendicular to the primary flat surface, but may be any one of a variety of angles, depending on the application. Where the wall is substantially perpendicular to the primary flat surface, the projection on the securing member extends substantially perpendicularly from the flange. Further, the display device enjoys improved flexibility of use by having a channel with a plurality of discrete apertures separated by individual spacer members. It is preferred that the raised lip on the display panel extends along substantially the entire length of the aperture, but alternatively the raised lip may extend along only a portion of the length of the aperture. To better stabilize the merchandise to be displayed, and further to permit the display of heavier objects, the flange on the display hook contacts the primary flat surface to distribute weight from the display hook onto the primary flat surface.

Figure 2:
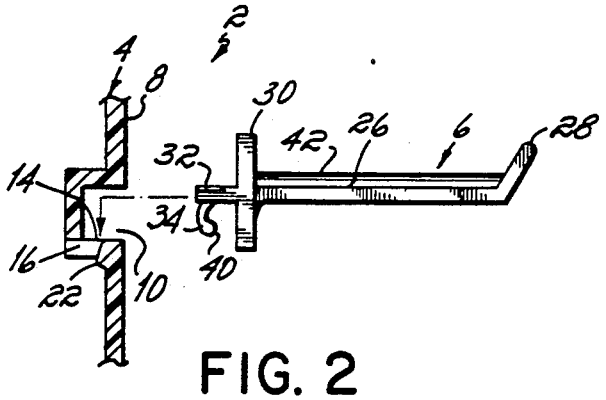
FIG. 2 is a cross-sectional view taken in lines 2—2 of FIG. 1 of a display hook disengaged from the display panel.

Referring to the drawings, FIG. 1 shows the display device 2 which is comprised of panel 4 and display hook 6. The panel 4 has a primary flat surface 8 and a channel 10 recessed therefrom. Channel 10 is comprised of at least one wall 14 which is substantially perpendicular to the primary flat surface 8 and which has at least one aperture 16 therein. The apertures 16 are separated by spacer members 18. As shown in FIG. 2, adjacent to the aperture 16 on the back side of the primary flat surface 8 is located a raised lip 22.

Figure 3:
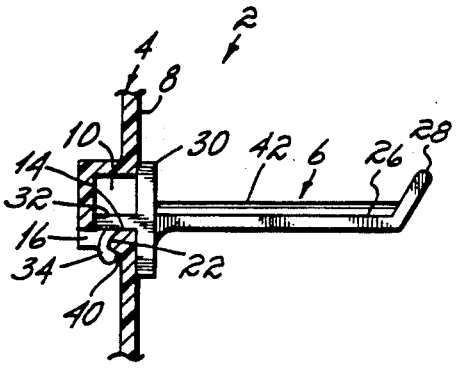
FIG. 3 is a cross-sectional view similar to FIG. 2 showing the display hook engaged in a locking relation to the display panel.

The display hook 6 is comprised of a support portion 26, a retainer portion 28, a flange 30, and a prong base 32, to which is connected the prong 34 as best shown in FIGS. 2 and 3. At the end of the prong 34 is an inwardly projecting tip 40. The display hook 6 is made more resistant to flexing by the inclusion of a reinforcing rib 42 which runs along the length of the support portion 26.

The display hook 6 is secured onto the panel 4 by inserting the prong base 32 into channel 10 and then pressing the display hook 6 downward so that the prong 34 enters the aperture 16 (FIG. 2). The prong 34 in combination with inwardly projecting tip 40 flexes as the tip 40 rides over the raised lip 22 and then reassumes its original orientation as the tip 40 moves beyond the raised lip 22 to thereby positively engage raised lip 22. The device with the display hook 6 coupled to the display panel is shown in FIG. 3. Note that the flange 30 makes contact with the front of the primary flat surface 8 when the display hook 6 is coupled to the panel 4. This arrangement increases the stability of the display hook 6 and permits heavier merchandise to be displayed without slippage of the display hook 6 or breakage of the coupling mechanism. To further increase the stability of the display hook 6, it is preferred that the flange 30 be sufficiently large to completely cover the channel 10, thereby providing contact with the primary flat surface 8 both below and above the channel 10.

As shown in the drawings, the wall of the channel 10 on which the apertures 16 are located is the bottom wall of the channel. Alternatively, the substantially perpendicular wall may be the top wall, and the display hook 6 so arranged that the prong 34 points upward instead of downward. Locking of the display hook 6 is then achieved by pressing the hook upward into the aperture 16. Further, the channel may run at an angle from the vertical, and the display hook prong 34 may be caused to point at any of a variety of angles to effect a locking arrangement with the raised lip 22. Also, note that the primary flat surface 8 may be placed in any of a number of positions relative to the ground, such as and including being suspended from a ceiling. It will be appreciated that the display hook retainer portion 28 can be formed in any of a number of shapes to be functional in response to the position of the primary flat surface 8.

In the figures, the display hook 6 is coupled to the display panel 4 by downward pressure which forces the flexible prong 34 with inwardly projecting tip 40 over and past the raised lip 22 to obtain positive locking. The display hook 6 is removed from the display panel 4 by grasping the support portion 26 and slightly twisting either clockwise or counterclockwise to raise the inwardly projecting tip 40 beyond the raised lip 22, and then lifting the hook 6 away from the panel 4.

The display device of this invention may be produced from any number of commercially available materials, such as styrene or acrylic resins. Preferably, the display panel 4 is produced from styrene resin; the display hook 6 is preferably produced from an amorphous copolyester polymer such as Eastman Kodak PETG Copolyester 6763. The KODAR copolyester has a glass-transition temperature of about 178° F., and is based on poly(ethylene terephthalate). The product also has a number average molecular weight of about 26,000. It is important that the prong 34 be produced from a flexible material which will permit the inwardly projecting tip 40 to ride over the raised lip 22 and then reassume its original position to achieve a coupling relationship with the panel 4.

The locking mechanism of this invention is useful in other applications where it is desired to employ a number of connection points on a fixed base with which attachment and removal of a securing member can be easily accomplished. Thus, it is envisioned that connector systems employing the locking mechanism of the above-described display device would have systems where maximum flexibility is desired, for wall or window display units where maximum product exposure in a tasteful manner is desired, and in other systems where such flexibility and ease of adjustment is important.

Thus, it is apparent that there has been provided, in accordance with the invention, a connector system and display unit which fully satisfies the objects, aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A connector system for securing objects to a fixed member comprising:

a panel having a primary flat surface with at least one channel recessed therefrom, said channel having at least one wall non-parallel to said primary flat surface, said wall having at least one aperture therein with a raised lip on the reverse side of said primary flat surface adjacent to said aperture; and a securing member having a flange with a projection extending therefrom, said projection attached to a prong having substantially the same length as said aperture, said prong having an inwardly projecting tip capable of engaging said lip adjacent said aperture.

2. The connector system of claim 1 wherein said channel is substantially horizontal.

3. The connector system of claim 1 wherein said wall of said channel is substantially perpendicular to said primary flat surface.

4. The connector system of claim 1 wherein said securing member projection extends substantially perpendicularly from said flange.

5. The system of claim 1 wherein said wall of said channel has a plurality of discrete apertures separated by individual spacer members.

6. The system of claim 1 wherein said raised lip extends along substantially the entire length of said aperture.

7. The system of claim 1 wherein said raised lip extends along only a portion of the length of said aperture.

8. The system of claim 1 wherein said flange contacts said primary flat surface both above and below said channel to distribute weight from said securing member thereto.

9. A device for displaying items of merchandise therefrom, comprising:

a display panel having a primary flat surface with at least one channel recessed therefrom, said channel having at least one wall non-parallel to said primary flat surface, said wall having at least one aperture therein with a raised lip on the reverse side of said primary flat surface adjacent to said aperture; and a display hook having a flange with a projection extending therefrom, said projection attached to a prong having substantially the same length as said aperture, said prong having an inwardly projecting tip capable of engaging said lip adjacent said aperture.

10. The device of claim 9 wherein said channel is substantially horizontal.

11. The device of claim 9 wherein said wall of said channel is substantially perpendicular to said primary flat surface.

12. The device of claim 9 wherein said display hook projection extends substantially perpendicularly from said flange.

13. The device of claim 9 wherein said wall of said channel has a plurality of discrete apertures separated by individual spacer members.

14. The device of claim 9 wherein said raised lip extends along substantially the entire length of said aperture.

15. The device of claim 9 wherein said raised lip extends along only a portion of the length of said aperture.

16. The device of claim 9 wherein said flange contacts said primary flat surface both above and below said channel to distribute weight from said display hook thereto.

17. A device for displaying items of merchandise therefrom, comprising:

a display panel having a primary flat surface with at least one substantially horizontal channel recessed therefrom, said channel having at least one wall substantially perpendicular to said primary flat surface, said wall having at least one aperture therein with a raised lip on the reverse side of said primary flat surface adjacent to said aperture; and a display hook having a flange with a projection extending substantially perpendicularly therefrom, said projection attached to a prong having substantially the same length as said aperture, said prong having an inwardly projecting tip capable of engaging said lip adjacent said aperture.

* * * * *